United States Patent [19]

Duvander et al.

[11] Patent Number: 4,921,121

[45] Date of Patent: May 1, 1990

[54] END CLOSURE FOR A PACKAGING CONTAINER

[75] Inventors: Patrik Duvander, Lund; Kent Johansson, Marieholm, both of Sweden

[73] Assignee: AB Akerlund & Rausing, Sweden

[21] Appl. No.: 309,254

[22] Filed: Feb. 10, 1989

[30] Foreign Application Priority Data

Feb. 16, 1988 [SE] Sweden ..... 8800512

[51] Int. Cl.[5] ..... B65D 41/50

[52] U.S. Cl. ..... 220/270

[58] Field of Search ..... 220/257, 270

[56] References Cited

U.S. PATENT DOCUMENTS 4,572,393 2/1986 Kobayashi et al. ..... 220/270

*Primary Examiner*—Donald F. Norton

*Attorney, Agent, or Firm*—Lerner, David, Littenberg, Krumholz & Mentlik

[57] ABSTRACT

An end closure for a packaging container where the closure is of the basic type having a so called one step opening arrangement, i.e. where an outer layer and an inner layer are removed in unison or simultaneously by shaping the tearing denotations in a proper pattern.

In order to provide an opening procedure giving less splash the outer layer is divided into a central part having a grip for individually removing the central part from the inner layer laying under the outer layer without being connected thereto.

A circumferentially extending region all around the closure, is defined by said circumferential tearing denotation and the central part and is removable together with the inner layer inside the tearing denotation.

11 Claims, 1 Drawing Sheet

END CLOSURE FOR A PACKAGING CONTAINER

FIELD OF THE INVENTION

The present invention relates to an end closure for a packaging container and more precisely that type of closure which allows a unison or simultaneous removal of at least two layers, an outer layer and an inner layer, and which is designed specifically for mastering any splash tendencies when opening a filled packaging container closed by an end closure.

BACKGROUND OF THE INVENTION

The state of the art literature is filled up with a variety of container closures. As far as multi layer closures are concerned, there are basically at least two main types, one where the end closure is penetrated in two steps, implying that the outer layer is first removed by a grip device and a tearing denotation, whereafter the inner layer is punctured, normally with any type of pointed object, and a second type where the outer layer and inner layer are removed in unison or simultaneously. Frequently, the former type of cover is identified as a two step cover and the latter one as a one step cover.

The technique of using a weld joint, adhesive joint or other connecting means at both sides of a tearing denotation, generally with a minor extension crosswise the tearing denotation is well established and a number of different techniques have been developed for providing and controlling the strength relations between the inner layer and the weld joint along the tearing denotations.

As mentioned at the introduction, splash sometimes will make it more difficult to handle the said one step end closures, resulting in an uncontrollable splashing and contamination.

OBJECTS OF THE INVENTION

The object of the present invention is to offer a structure which eliminates such a deficiency, but still possesses the rest of the preferable qualities of one step container closures.

SUMMARY OF THE INVENTION

Thus, the invention provides an end closure for a packaging container, comprising at least an outer and an inner layer, where the outer layer has an easy opening arrangement having a grip and a tearing denotation starting therefrom, said denotation having a portion extending circumferentially the whole way around the end closure close to a circumferential rim, and where the inner layer is attached to the outer layer at both sides of the circumferential denotation and the joint between the outer layer and the inner layer is stronger than the tearing strength of the inner layer.

The container closure is characterized in that the outer layer is divided into a central portion having a grip for individually removing the central portion from the inner layer, laying below the outer layer but not connected thereto, and in that a circumferentially, all around the closure extending region of the outer layer is defined by said circumferential tearing denotation and the central portion and is removable together with the inner layer inside the tearing denotation, by means of a grip portion arranged in the circumferential region for allowing tearing along the circumferential tearing denotation.

In one embodiment the circumferential, all around the end closure extending region of the outer layer is strip shaped and is provided with a grip or grip facilitating surface at one end thereof.

The arrangement according to the present invention is especially useful in applications where the inner layer is a thin layer of a high barrier material, for instance metal foil, and the outer layer is a layer of thicker material, for instance plastics, for mechanically protecting the inner layer.

DESCRIPTION OF PREFERRED EMBODIMENTS

Figure 1:
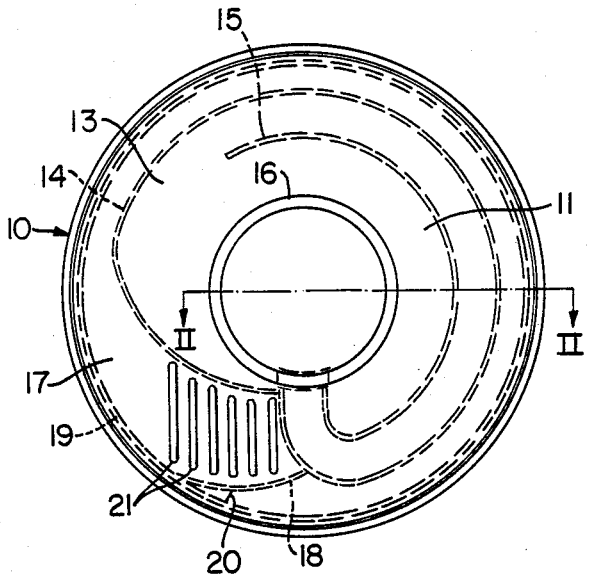
FIG. 1 is a view from above of a closure for a packaging container.
Figure 2:
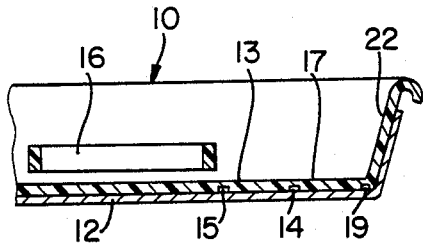
FIG. 2 is a partial section along line II—II in FIG. 1.

The closure or so called end closure in FIG. 1 is useful not only for closing container ends but, of course, the closure may be used for whatever container having a proper connecting piece or corresponding for the said object.

The closure 10 in FIG. 1 comprises two layers, one outer layer 11 and an inner layer 12. The outer layer 11 is formed by an injection mouldable material, for instance plastics, or another type of material allowing a similar advantageous and economic manufacturing technique. However, it should be noted that the wall thickness of the outer layer is small, one or a few millimeters in the thicker regions and some tenths of a millimeter in the area of the tearing denotations. The injection moulding technique that has been suggested involves a number of technical subsolutions which as such are not necessary for an understanding of the structure of the closure in FIG. 1, but further teaching may be found in parallel patent applications filed the same day as this application.

The element 11 forming the outer layer comprises a central cover panel or part 13 which radially outwards is defined by a tearing denotation 14. In said element 13 there is a further tearing denotation 15 which, like the denotation 14, starts from a grip in the shape of a pull ring 16.

The region below the central element 13, i.e. the region between said element and the inner layer 12 is completely unsealed to the inner layer and does not have any other type of interconnecting portion, meaning that the element 13 is releasable from the closure as soon as the tearing up by means of the pull ring 16 along the tearing denotation 14, 15 has been completed.

Such an initial tearing away of central portion having a relatively large area means that the product, for instance liquid, inside the container closed by the closure, at a following step including the removal of the remaining strip shaped outer layer element 17, does not create such a heavy movement of the product as the direct removal of an outer layer covering 100% of the opening area together with the inner layer. The inner layer which is relatively thin, has a certain flexibility. Thus the inner layer is able to prevent any spill which might otherwise result from the removal of the central material of the closure by removal of the second tearing strip.

The strip 17 has a short tearing denotation portion 18 which merges into the circumferential tearing denotation 19 extending all around the closure.

The strip end which is gripped at the tearing operation has a number of ribs 21 for facilitating the grip.

As appears from FIG. 1 the strip portion 17 merges into a circumferential rim 18 at said tearing denotation 19. The inner layer 12, for instance a plastics coated aluminum foil is attached to the outer layer 10 in a radially narrow region at both sides of the tearing denotation 19. Such an attachement may be obtained by the type of induction welding technique or a high frequency welding that is described in the patent applications previously mentioned. Of course, if so desired, a radially broader region may be attached to the outer layer, however, this does not normally facilitate a one step tearing up operation. Basically, there is nothing that forbids the attachement of the entire area of the inner layer 12 to the outer layer 10, however, this will then of course make the tearing up along the different tearing denotations heavier and more difficult.

We claim:

1. An end closure for a packaging container comprising: at least an outer layer and an inner layer, said outer layer having a circumferential rim defining an outer periphery of said end closure, and an easy opening device integrally attached thereto, said rim and said easy opening device being joined in the proximity of at least a first circumferential tearing denotation spaced inwardly from said rim, said easy opening device having a first tearing strip defined by said first circumferential tearing denotation, a second circumferential tearing denotation spaced inwardly from said first circumferential tearing denotation, and an intermediate tearing denotation joining said first and said second circumferential tearing denotations, said first tearing strip further defining a first grip, and said easy opening device having a second tearing strip defined by said second circumferential tearing denotation and a substantially semicircular tearing denotation spaced inwardly from said second circumferential tearing denotation, said second circumferential tearing denotation and said substantially semicircular tearing denotation being attached to a second grip, and wherein said inner and said outer layers are attached at a joint at least at both sides of said first circumferential tearing denotation, said joint between said outer and said inner layer being stronger than the tearing strength of said inner layer.

2. The end closure of claim 1, wherein said inner layer is a thin layer of high barrier material.

3. The end closure of claim 2, wherein said inner layer is a metal foil.

4. The end closure of claim 1, wherein said outer layer is generally thicker than said inner layer of injection mouldable material.

5. An end closure for a packaging container comprising an outer layer and an inner layer, said outer layer including a circumferential rim defining an outer periphery of said end closure and an easy opening device including a plurality of tearing strips, said rim and a first tearing strip of said plurality of tearing strips being integrally joined in the proximity of a first circumferential tearing denotation spaced inwardly from said rim, and said first tearing strip of said plurality of tearing strips being integrally joined to a second tearing strip of said plurality of tearing strips in the proximity of a second circumferential tearing denotation spaced inwardly from ssaid first circumferential tearing denotation, and wherein said inner layer is joined to at least said circumferential rim and said first tearing strip of said plurality of tearing strips of said outer layer, said joint between said outer layer and said inner layer being stronger than the tearing strength of said inner layer.

6. The end closure of claim 5, wherein said inner layer is a thin layer of high barrier material.

7. The end closure of claim 6, wherein said inner layer is a metal foil.

8. The end closure of claim 5, wherein said outer layer is generally thicker than said inner layer of injection moldable material.

9. The end closure of claim 5 wherein said first tearing strip of said plurality of tearing strips is provided with a grip.

10. The end closure of claim 5 wherein said first tearing strip of said plurality of tearing strips is provided with a grippable surface at an end thereof.

11. The end closure of claim 5 wherein said second tearing strip of said plurality of tearing strips is provided with a grip.

* * * * *